US006367215B1

(12) United States Patent
Laing

(10) Patent No.: US 6,367,215 B1
(45) Date of Patent: Apr. 9, 2002

(54) MODULAR CONSTRUCTION SYSTEM

(76) Inventor: Gordon G. Laing, 1815 - 40$^{th}$Avenue SW., Calgary, Alberta (CA), T2T 2L7

( * ) Notice: Subject to any disclaimer, the term of this patent is extended or adjusted under 35 U.S.C. 154(b) by 0 days.

(21) Appl. No.: 09/588,554

(22) Filed: Jun. 7, 2000

(30) Foreign Application Priority Data

Jun. 8, 1999 (CA) ..... 2273757

(51) Int. Cl.$^{7}$ ..... E04B 1/38; E04B 1/61

(52) U.S. Cl. ..... 52/271; 52/284; 52/157; 52/586.2; 52/590.2; 52/783.19; 52/747.1

(58) Field of Search ..... 52/586.2, 586.1, 52/590.1, 590.2, 271, 284, 747.1, 157, 783.17, 783.19

(56) References Cited

U.S. PATENT DOCUMENTS

| | | | | | |
|---|---|---|---|---|---|
| 1,474,148 | A | * | 11/1923 | Hopkins | 52/586.1 X |
| 1,985,992 | A | * | 1/1935 | Hayman | 52/284 X |
| 2,144,630 | A | * | 1/1939 | Kotrbaty | 52/586.1 X |
| 2,228,363 | A | * | 1/1941 | Pinney | 52/586.2 X |
| 3,076,286 | A | * | 2/1963 | Czecholinski | 52/590.1 X |
| 3,305,982 | A | * | 2/1967 | Steele | 52/590.2 X |
| 3,547,472 | A | * | 12/1970 | Ehrman | 52/590.2 X |
| 3,603,053 | A | * | 9/1971 | Van Loghem | 52/586.2 X |
| 3,611,667 | A | * | 10/1971 | Maxwell | 52/747.1 |
| 4,037,379 | A | * | 7/1977 | Ozanne | 52/783.17 X |
| 4,400,925 | A | * | 8/1983 | VanLoghem et al. | 52/586.1 X |
| 4,628,650 | A | * | 12/1986 | Parker | 52/284 X |
| 5,761,862 | A | * | 6/1998 | Hendershot et al. | 52/271 |
| 6,085,469 | A | * | 7/2000 | Wolfe | 52/284 X |

FOREIGN PATENT DOCUMENTS

| | | | | |
|---|---|---|---|---|
| AU | 138005 | * | 5/1948 | 52/783.17 |
| DE | 21 56 901 A | | 5/1973 | |
| DE | 2656025 | * | 6/1978 | 52/586.2 |
| EP | 0 886 016 A | | 12/1998 | |
| FR | 2372341 | * | 6/1978 | 52/586.2 |
| GB | 11203 | * | 6/1895 | 52/157 |
| GB | 484750 | * | 5/1938 | 52/586.2 |
| IT | 719512 | * | 11/1966 | 52/586.2 |
| SE | 188645 | * | 3/1964 | 52/783.17 |
| WO | WO 97 17506 A | | 5/1997 | |
| WO | WO 98 34032 A | | 8/1998 | |

* cited by examiner

*Primary Examiner*—Robert Canfield
(74) *Attorney, Agent, or Firm*—Sean W. Goodwin

(57) ABSTRACT

A modular construction system utilizes building components or panels formed of high strength plasticized concrete. Panels are formed with two or more linear peripheral edges fitted with mortises. FRP pultruded tenons are used to connect aligned mortises for adjacent panels. Walls, crown beams and roof panels can be so formed and assembled. Hollow corrugated panels are suitable for forming beams and interior partitions. Beams can be rested on regularly spaced piles and then floor panels on the beams, walls on the floor panels, crown beams on the walls and roof panels on the crown beams, buildings can be erected with a minimum of tools or specialized knowledge. The resulting structure is substantially impervious to environmental hazards, particularly relevant in more primitive locations.

18 Claims, 14 Drawing Sheets

MODULAR CONSTRUCTION SYSTEM

FIELD OF THE INVENTION

This invention relates to the modular construction of buildings and more particularly to the use of a modular system of load-bearing concrete panels and connectors to build housing.

BACKGROUND OF THE INVENTION

It is known to construct buildings using rigid frameworks such as wooden studs or steel girders, and providing external covering material such as wooden sheeting or concrete panels and internal coverings such as drywall.

The construction of such buildings is expensive and time consuming and requires special materials, tools and expertise. This is especially true for the construction of buildings that are fire-resistant and capable of withstanding tornadoes, earthquakes, moisture related damage and insect infestation.

It is also known to use modular systems, comprising prefabricated load-bearing panels. If created from concrete, such panels are often very heavy and have little insulating value. Insulation does not adhere well to concrete and the resulting panels are not composite in nature. Further surface finishing requires the use of craftsmen.

With an eventual shortage of natural building materials such as lumber and the lack of skilled craftsmen in many areas of the world, the current invention provides a modular, rapid, construction system that does not require conventional fasteners and is easily put together with minimal skill.

SUMMARY OF THE INVENTION

A modular construction system is provided for erecting buildings with a minimum of tools or specialized knowledge. The resulting structure and its' material of manufacture ensure it is substantially impervious to environmental hazards, particularly relevant in more primitive locations.

High strength composite concrete panels utilize plasticized high strength concrete. The panels can be precision factory produced for hand assembly in the field and are provided in both corrugated and channel or ribbed forms. Panels can be pre-formed with openings such as window's and doors and have pre-finished surfaces. Light, hollow corrugated panels have a zigzag high strength concrete shape sandwiched and secured with adhesive between two flat high strength concrete panels. For panels applied to the building exterior, low-weight, ultra low tensile aerated concrete can be added between ribs as insulation and added rigidity.

The composite concrete panels integrate edge connection means which interlock to each other and to primary concrete building components such as complimentary pilings, wall footings, crown beams and roof purlin connectors. These connectors are particularly amenable for installation by hand.

As a result, structures, such as housing, can be erected on-site, with a minimum of equipment and without the requirement for craftsmen.

In one embodiment, the edge connection means comprise C-shaped FRP extrusion for forming a mortise about the periphery of the panels. For composite corrugated panels, the mortises are formed of extruded plastic, sandwiched between high strength concrete sheets. In channel panels and building components, the mortise preferably take the form of dovetail grooves formed directly in the panel's concrete.

Each of the C-shaped or dovetail mortises accepts one lateral half of a pultruded epoxy, fiber-reinforced joiner or tenon insert having an X-shaped cross-section. When mortises of components and panels are facing or adjoining each other, they form a cavity into which these X-connectors can be inserted as a tenon, locking the components and panels, or panel to panel, together. Unlike concrete, the X-connector tenons are elastic and are forgiving of misalignment and movement.

Using the X-connector tenons, a floor channel panel having a downward facing groove can be locked to a piling having an upward facing and complementary groove. The bottom of a wall panel can be locked to the floor panel. A crown beam can be locked to the top of the wall panel and the bottom of a roof panel can be locked to the crown beam.

Preferably, the crown beam has a low profile by providing a greater lateral dimension than height. This unconventional orientation also aids in providing lateral strength to resist roof-spreading loads and transferring them vertically into the walls. Advantageously, the lateral extension also make it possible to secure exterior gutter and interior valences thereto, preferably using the same X-connector tenons.

Further, adjoining roof panels can be connected using purlin connectors having a deep depending rib portion for adding extra beam section and strength to the roof structure.

In the broadest form of the invention, a method of modular concrete construction comprises providing two or more lightweight composite concrete building components having one or more linear peripheral edges formed with linear dovetailed fitting mortises, providing one or more flaring tenons, aligning two adjacent building components with facing fitting mortises, and joining the aligned panels by inserting one or more of the flaring tenons along the peripheral edge and into the facing fitting mortises so that the panels cannot be separated.

Preferably this method is applied to the formation of walls panels for forming a walled structure, all of which are joined using the mortises and tenons. This method of construction can be extended to form a plurality of components for forming a wide crown beam which rests atop the walled structure and supports a plurality of roof panels resting thereon.

More preferably, additional building components such as floor panels can be similarly formed. Using the lightweight composite concrete, corrugated panels can be formed of a profiled or corrugated sheet glued sandwiched between two sheets. These corrugated panels, fitted with mortises, can be used a beams as part of a suspension system, resting on piles, or assembled as interior partitions.

BRIEF DESCRIPTION OF THE DRAWINGS

FIG. 10*a* is a overall arrangement illustrating a side view of a partition butted up to and illustrating a cross-section of an exterior wall;

FIG. 10*b* is a plan cross-sectional view detail showing the strip connector between the partition and the a complementary slot at the joint between two exterior wall panels;

FIG. 10*c* is a plan cross-sectional view detail showing the interlocking of adjacent partitions;

FIG. 10*d* is a side cross-sectional view of the top and bottom partitions illustrating capping and hook and loop fastener between the partition bottom and the floor;

Figure 3:
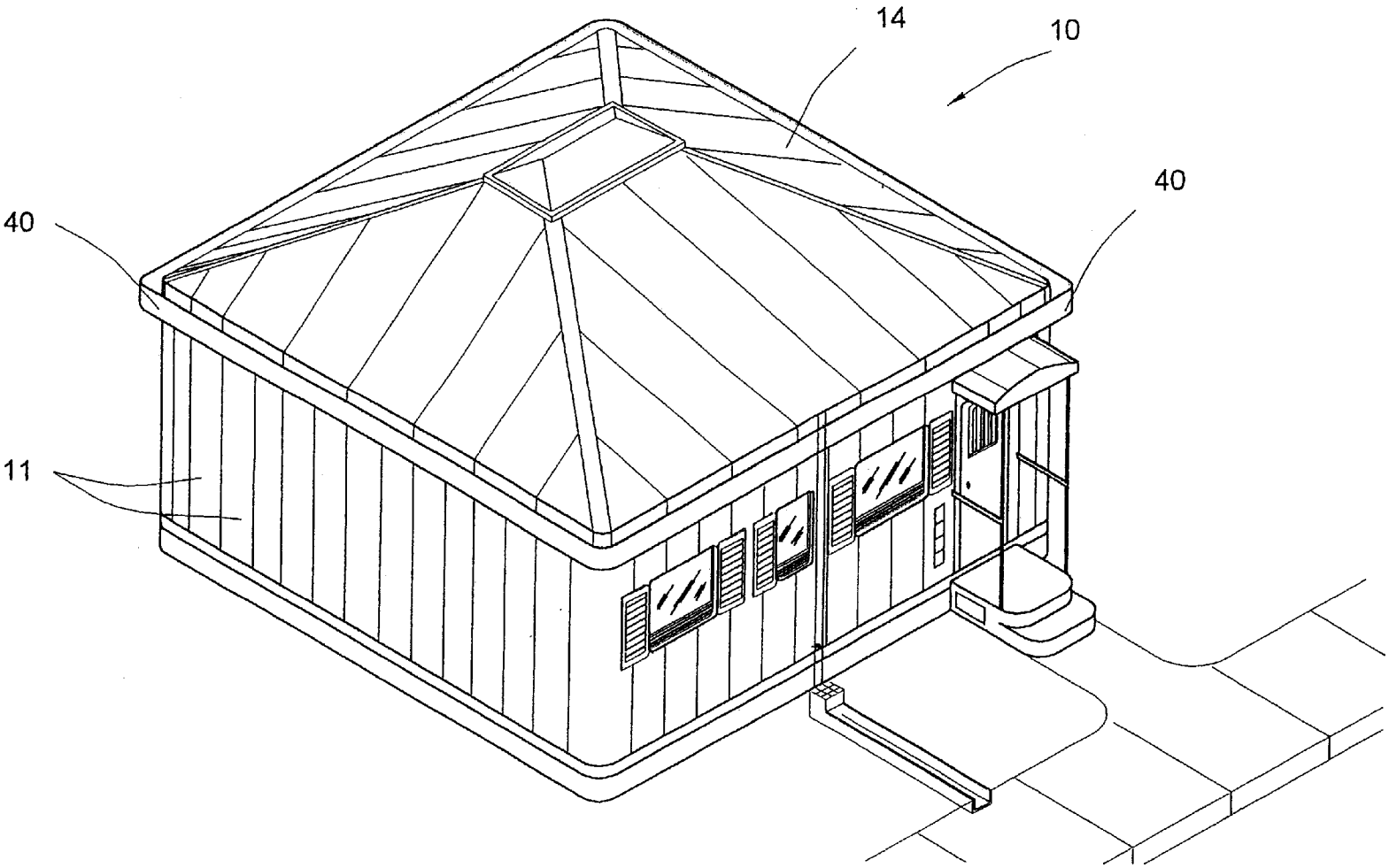
FIG. 3 is a perspective view of a building constructed using one embodiment of the invention and illustrating the concrete culvert detail.
Figure 14H:
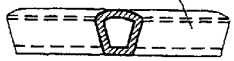
FIGS. 14*a*–14*h* illustrate structural framing details.
Figure 14A:
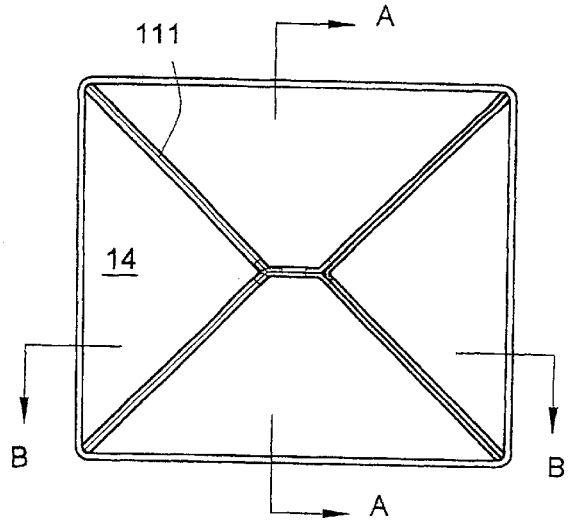
Figure 14G:
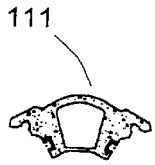
Figure 14F:
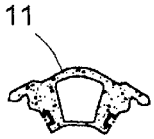
Figure 14E:
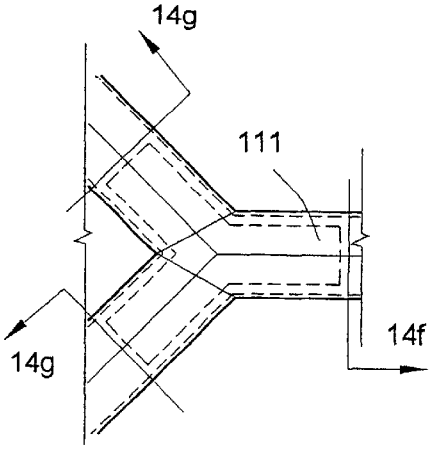
Figure 14D:
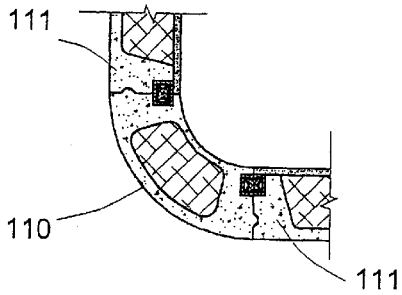
Figure 14B:
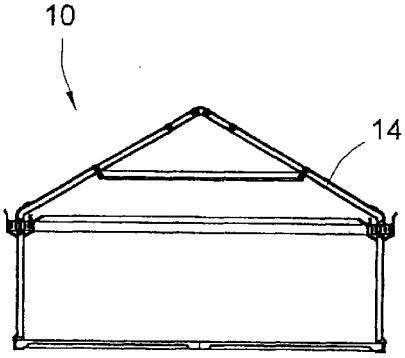
Figure 14C:
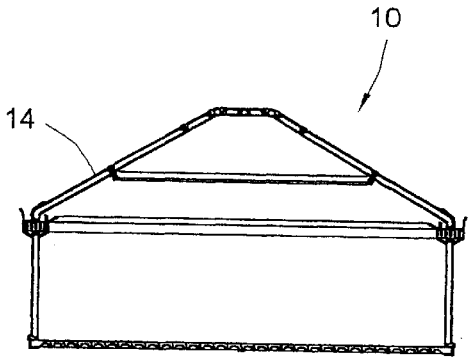

a. is a plan view of the building of FIG. 3;

b. is a cross-sectional view according to lines A—A of FIG. 14*a;* c. is a cross-sectional view according to lines B—B of FIG. 14*a;* d. is a plan cross-sectional view of a wall corner of FIG. 14*a;* e. is partial plan view of the hip and peaks of the building of FIG. 14*a;* f. is a cross-sectional view of the hip and peak sections of FIG. 14*e* along lines f—f;

g. is a cross-sectional view of the hip and peak sections of FIG. 14*e* along lines g—g; and h. is an elevation view of the hip and peak connector of FIG. 14*e.*

DETAILED DESCRIPTION OF THE PREFERRED EMBODIMENT

Figure 1:
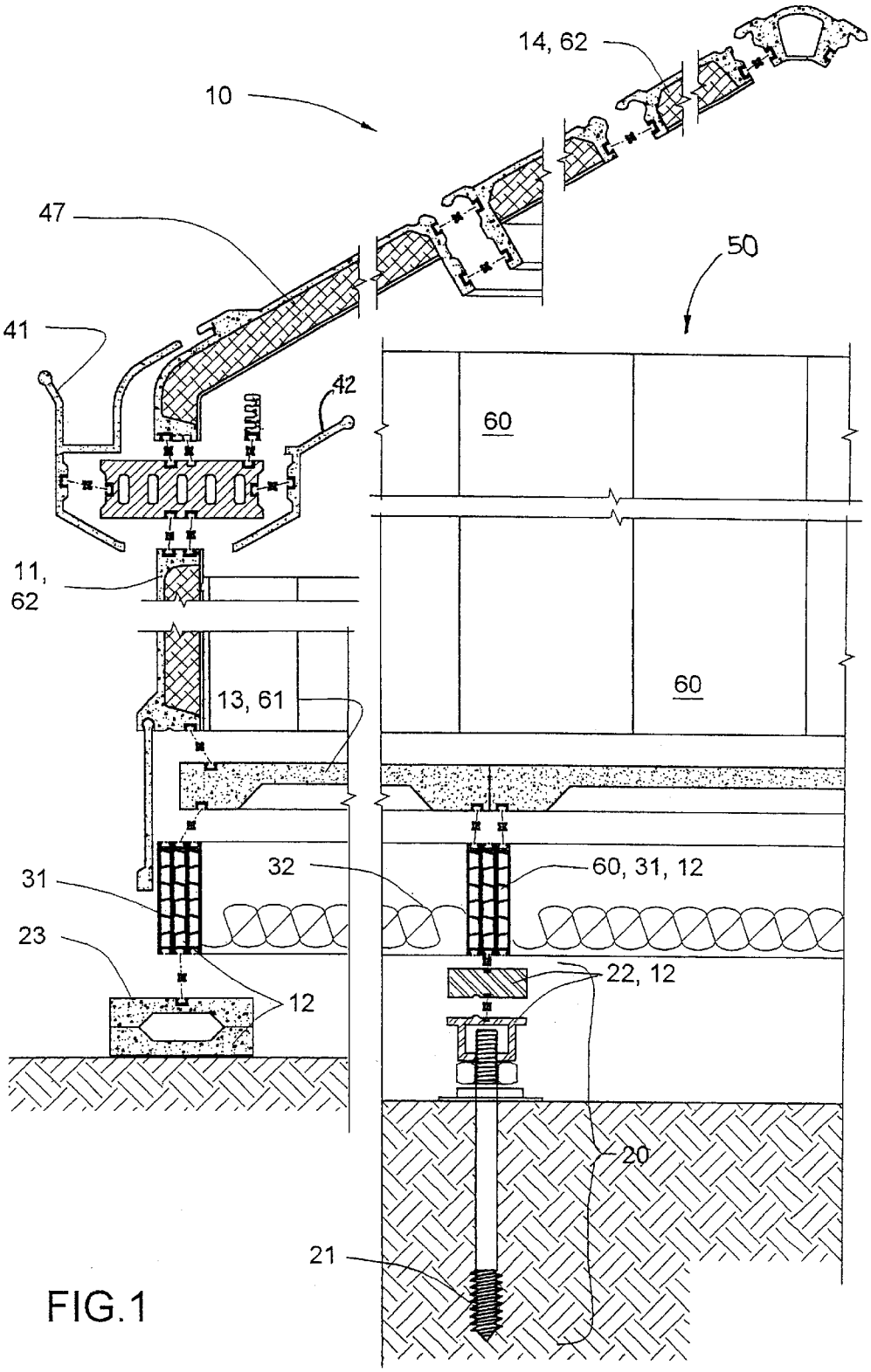
FIG. 1 is an exploded cross-sectional view of one half of a modular building manufactured in accordance with a preferred form of the present invention.
Figure 2:
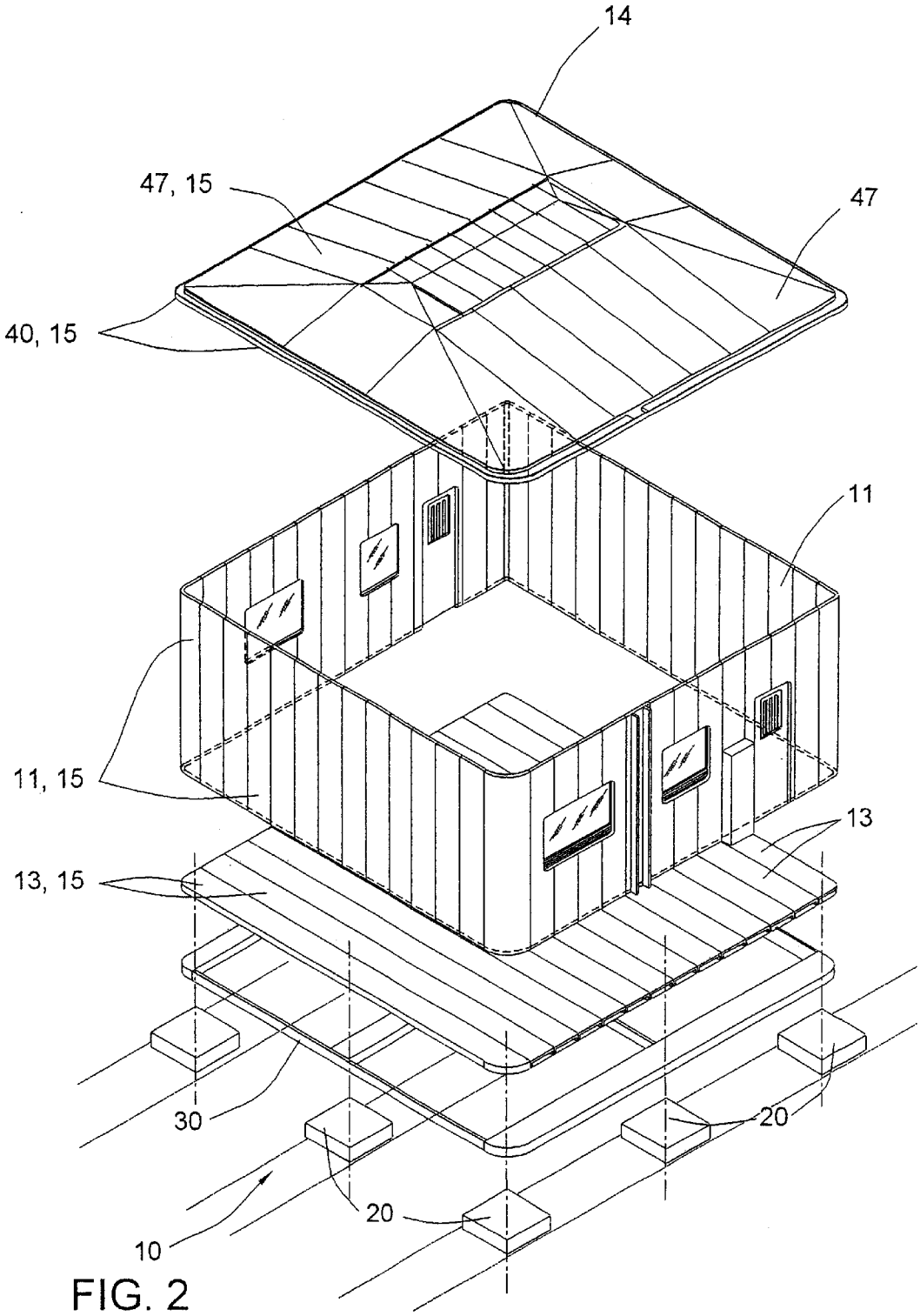
FIG. 2 is an exploded view of the construction components of a building manufactured in accordance with the invention.

Overall, and shown generally in FIGS. 1,2, and 3, there is disclosed a concrete building 10 and method of construction of same which comprises a connecting a plurality of exterior walls 11, a support or suspension system 12, a floor 13 and a roof 14, all of which are manufactured of composite concrete components. Individual building components 15 interlock with each other and with other building components with a consistent arrangement of dovetail-like mortises 16 and tenon connectors 17.

It is instructive to first identify the building's major components and then describe them in greater detail thereafter.

Figure 4B:
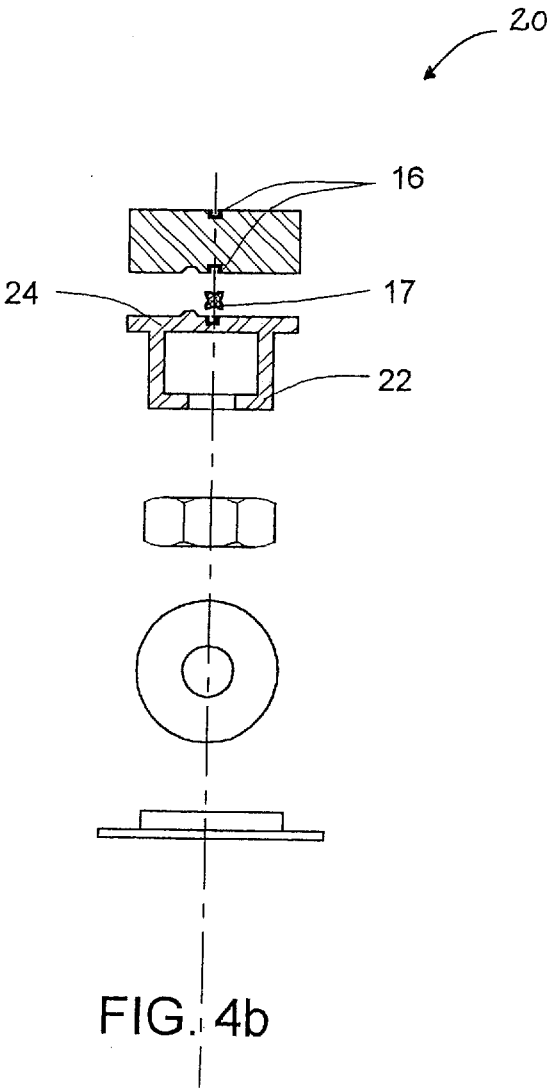
FIGS. 4*a* and 4*b* are side and exploded fastener views respectively of the rock pile.
Figure 4A:
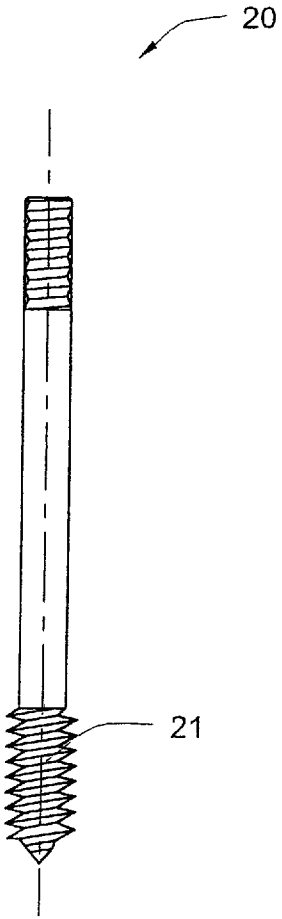

As shown in overall FIGS. 1, 4*a* and 4*b,* a pile 20 comprising an epoxy-resin fiber-reinforced (FRP) auger 21 and a square milled top 22 form a suspension system 12 for use in soil footings.

Figure 5:
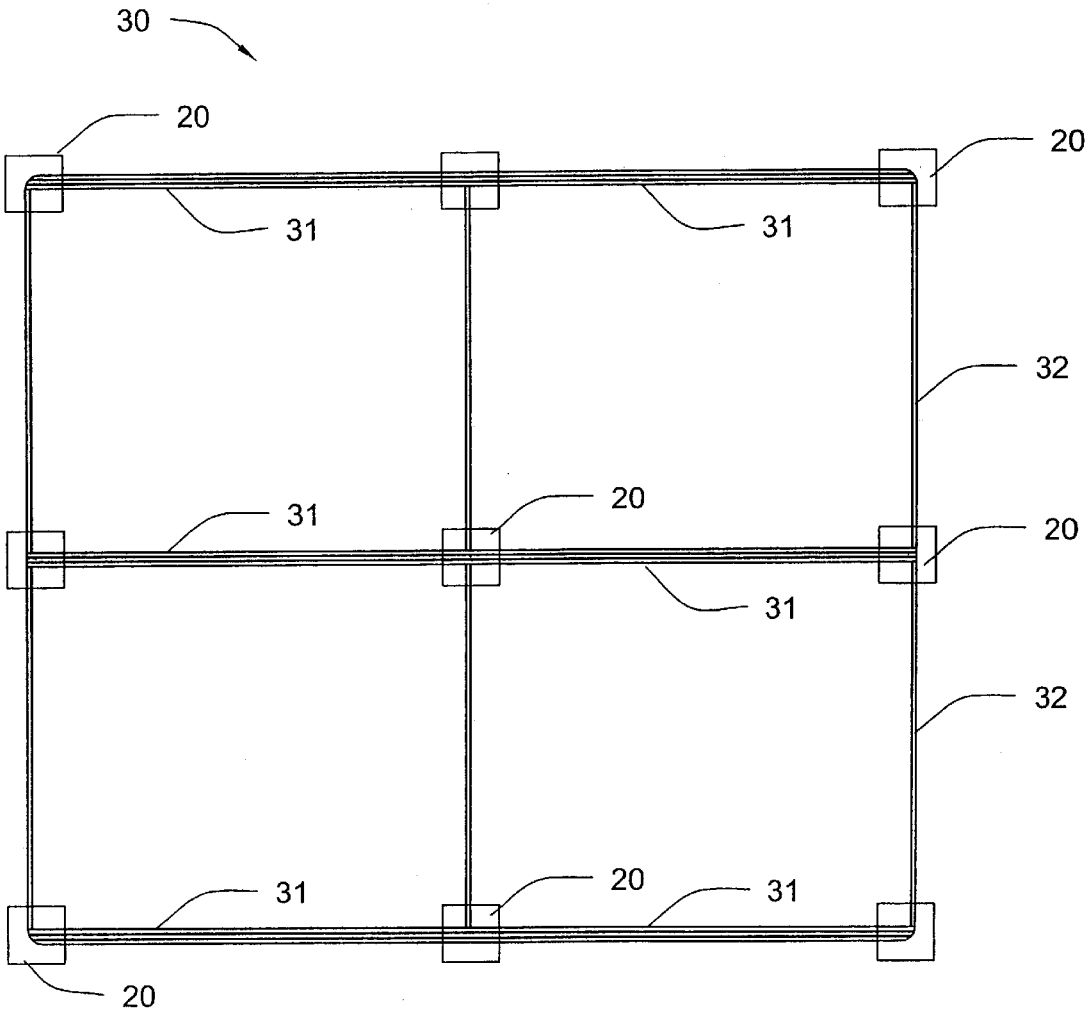
FIG. 5 is a plan view of a nine-pile grid.

Having reference also to FIG. 5, a rectangular suspension grid 30 is formed for a total of nine piles 20 in a 3-by-3 arrangement. A grid shaped pattern (not shown) can be employed to ensure accurate positioning of the piles 20. Each pile 20 connects to and supports the ends of floor beams 31 spanning between piles 20. Typically, six strong, three-ply floor beams 31 run end to end, in co-axially extending pairs, running parallel each other pair spaced by three pairs of transverse, single-ply, weaker floor beams 32. Floor panels 13, having a channel profile, span the entire length of the 3 piles 20 aligned perpendicular to the strong beams 31.

Exterior walls 11 stand vertically from and interlock with the periphery of the floor panels 13.

Figure 6:
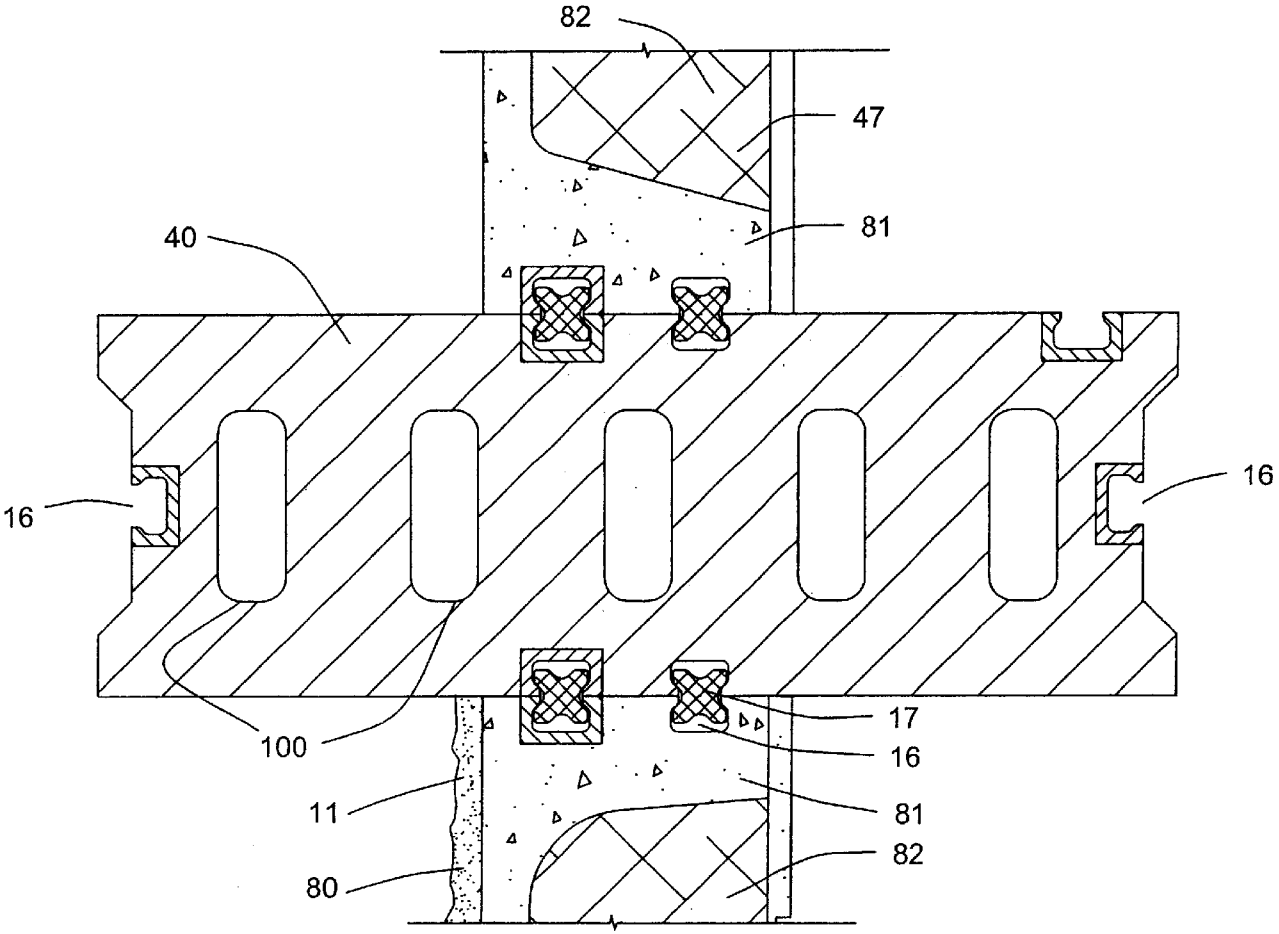
FIG. 6 is a partial cross-sectional detailed view of the crown beam and interlocking to the roof and wall panels.
Figure 7:
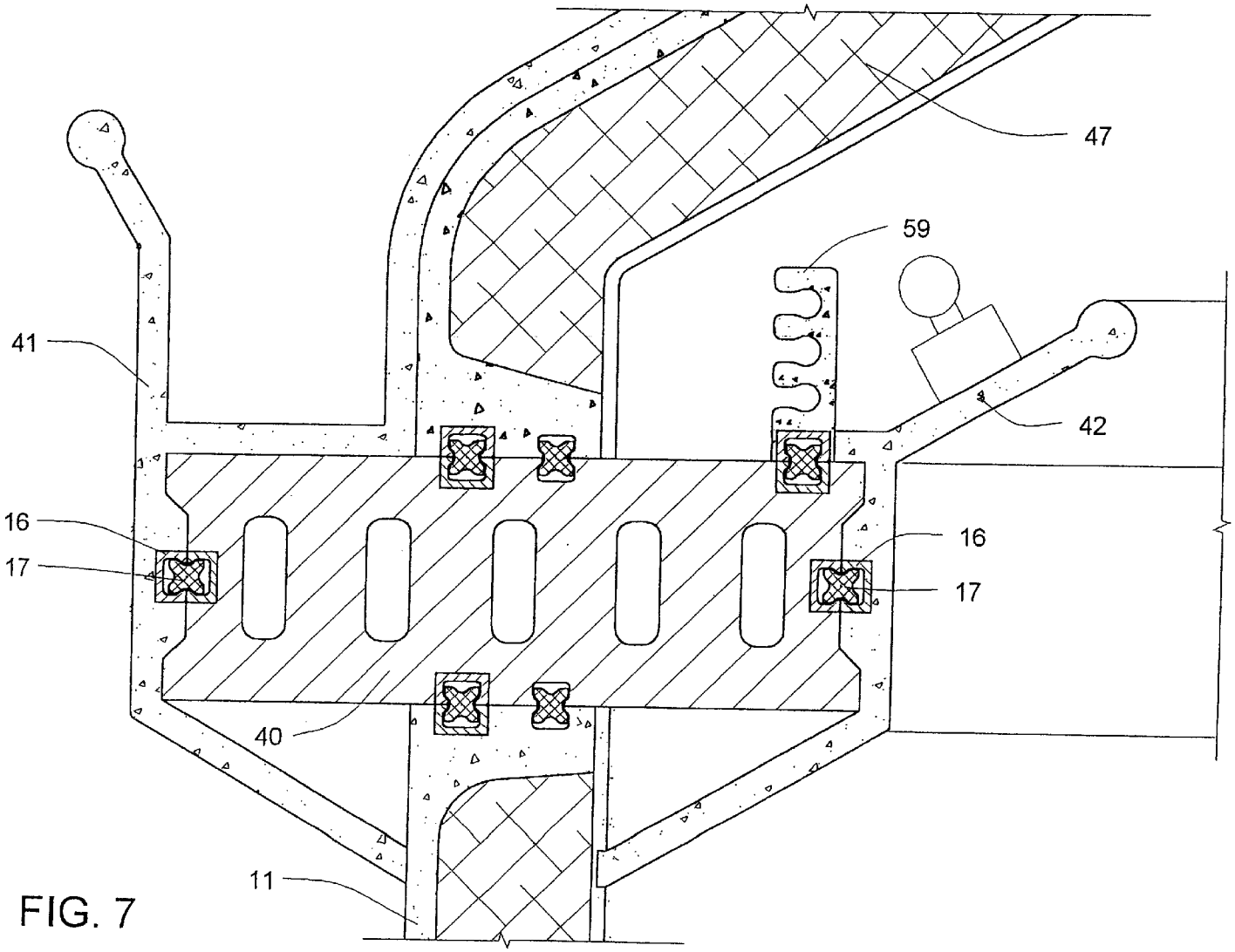
FIG. 7 is a partial cross-sectional detailed view of the crown beam with interlocked exterior gutter and interior valance.

As shown in detailed FIGS. 6 and 7, a header or crown beam 40 interlocks with and extends about the top of the walls 11. Exterior rain gutters 41 and interior valence and utility tray 42 are interlocked to and are supported from the crown beam 40.

Figure 8:
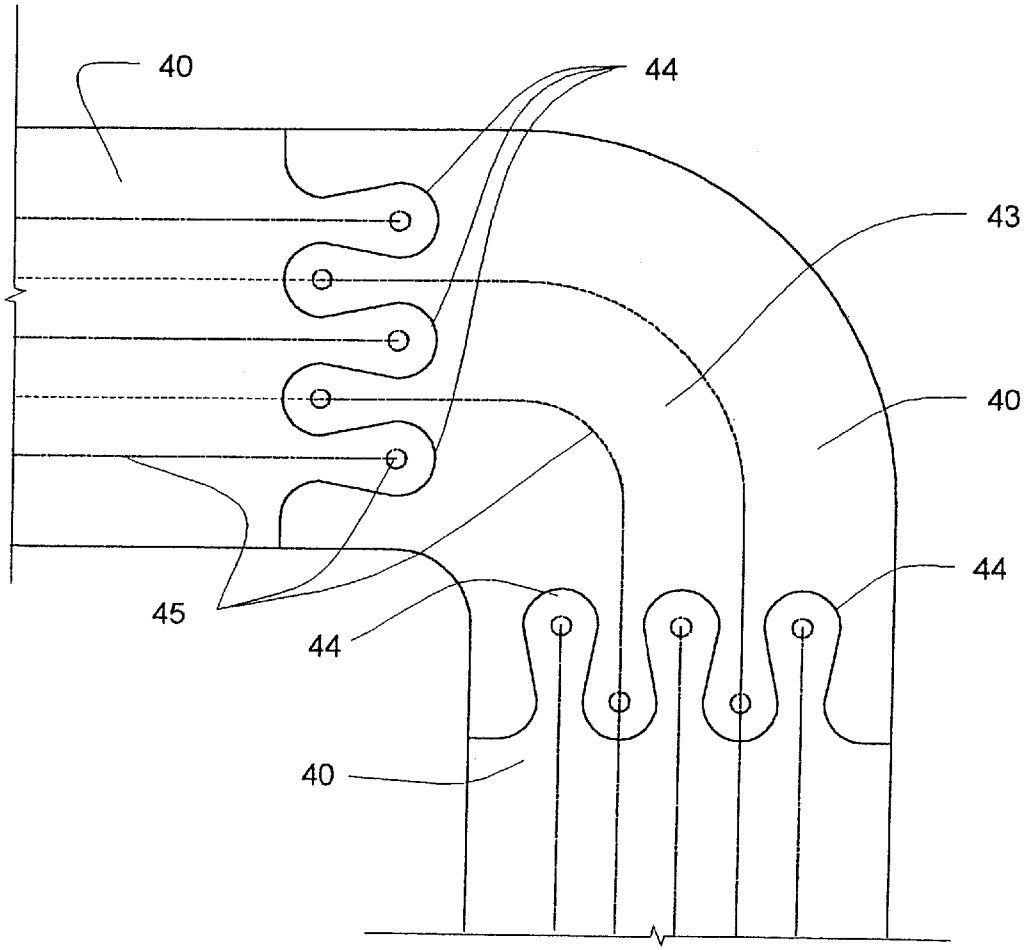
FIG. 8 is a partial cross-sectional plan view of a 90° corner crown beam.

At wall corners, a 90° curved section 43 of crown beam 40, seen in FIG. 8, is used to connect linear sections 40. Interlocking, vertically tapered fingers 44 provide a connection to resist lateral separating forces. Internal reinforcement is provided using epoxy/fiberglass (FRP) pultruded reinforcing rods 45.

Figure 9:
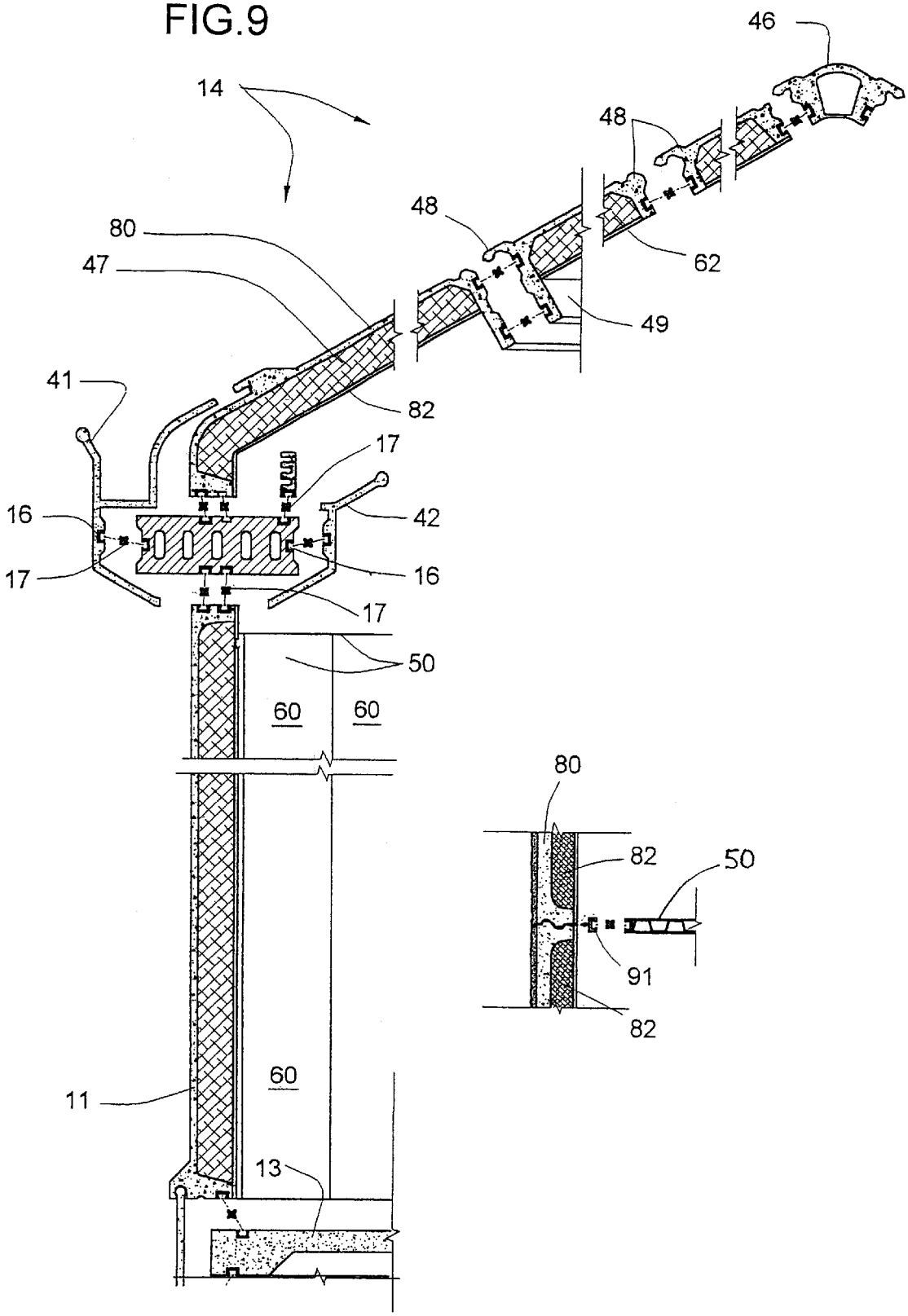
FIG. 9 is a partial cross-sectional view of part of the wall panels, the crown beam and roof panels accordingly to FIG. 1.

Sectional roof panels 14 interlock with and are supported atop the crown beam 40 as seen in FIGS. 1 and 9. A cottage-style roof 14 is shown which extends vertically upwardly and then deviates laterally to approach the peak and a peak connector 46 at an angle. Best shown in FIG. 9, compound curved panels 47 provide the section of the roof 14 adjacent the crown beam 40. Flat panels 48 constitute the balance of the roof panels 14. Dependent upon the span of the roof 14, flat roof panels 48 are occasionally interlocked to one another using a purlin connector 49, providing a locally increased and strong beam section.

Interior partitions 50 shown in FIGS. 10*a*–10*d,* interlock at interfaces 51 between adjacent wall panels 11 and are attached to the floor panels 13.

More specifically, three basic panel types are pre-formed using high strength concrete: a corrugated structural panel 60 for forming beams 31,32 and interior partitions 50; a channel form 61 for floor panels 13; and an insulated channel 62 for forming exterior wall 11 and roof panels 14.

Corrugated Panels—Beams and Partitions

Having reference to FIGS. 8 and 10*a*–10*d,* panels 60 for partitions 50 and beams 31,32 are planer composite corrugated panels entirely constructed of a matrix of high-density, high strength, plastic and fiber-reinforced concrete (hereinafter "HS concrete").

Concrete having strength of 5,000 psi or greater is preferred. As shown, each panel 60 can be readily factory mass-produced by forming of first and second planer sheets 70,70 of HS concrete with a third corrugated sheet 71 sandwiched therebetween. The corrugated sheet 71 is molded in a zigzag pattern, having alternating angular sections 71*a* and short planer sections 71*b* for spacing the planer sheets 70,70 apart. The first and second planer sheets 70,70 are secured at the third corrugated sheet's short planer sections 71*b* with an adhesive mortar. The result is a lightweight concrete panel 60 which is strong, without the requirement for reinforcing tensile bar and which is substantially invulnerable to natural degradation. Optionally, the corrugations can be filled with insulation.

Opposing linear peripheral edges 72 of each substantially rectangular corrugated panel 60 is fitted with a structural plastic C-shaped extrusion 73. The C-shaped extrusion 73 has an open side 74 which is oriented outwardly from the panel 60. The C-shaped extrusion 73 has inward-facing flanges 75 at the open side 74 for constricting the opening and forming a mortise 16. It is understood that the term mortise 16, used herein, refers to any peripheral edge connector which has a larger internal dimension that outer dimension, such as a dovetail, thus being capable of retaining a tenon 17.

Figures 12A, 12B:
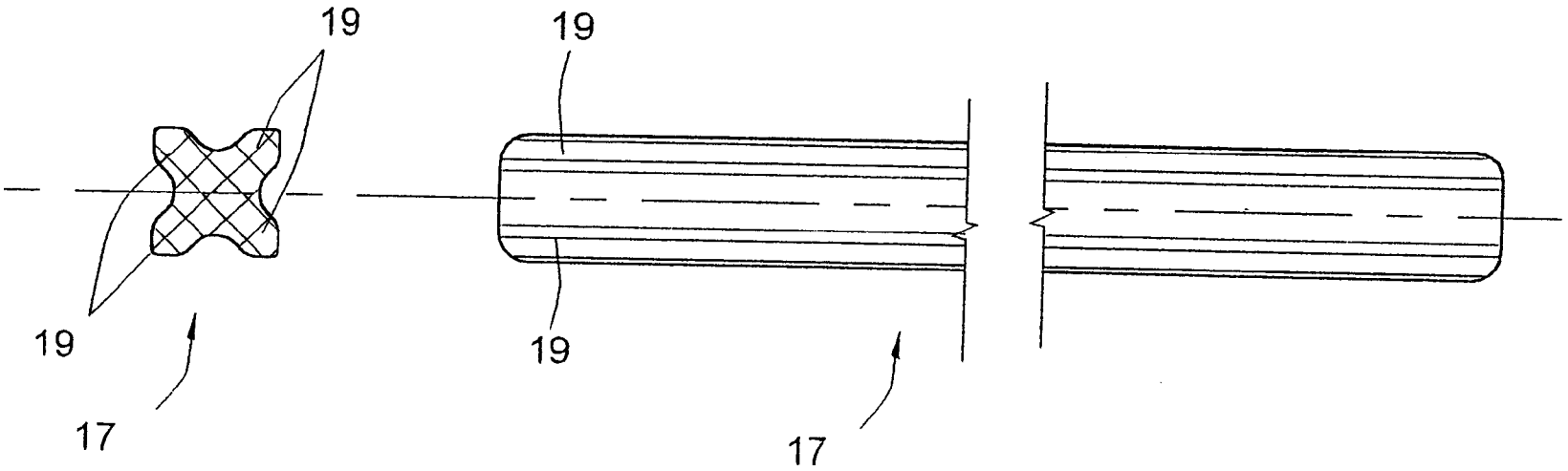
FIGS. 12*a* and 12*b* are an end cross-sectional view and a side view of the X-connector.

Having reference to FIG. 12*a* and 12*b,* linear tenons 17 are formed from epoxy resin over a matrix of fiberglass strands (FRP) pultruded through X-shaped dies. As a result, tenons in the form of X-connectors are formed having an X cross-section of 4 symmetrical radially extending wings 19. As described below, the resultant X-connector tenons 17 are used to connect adjacent and facing mortises of corrugated panels 60, both to each other and to other building components 15.

Figure 10B:
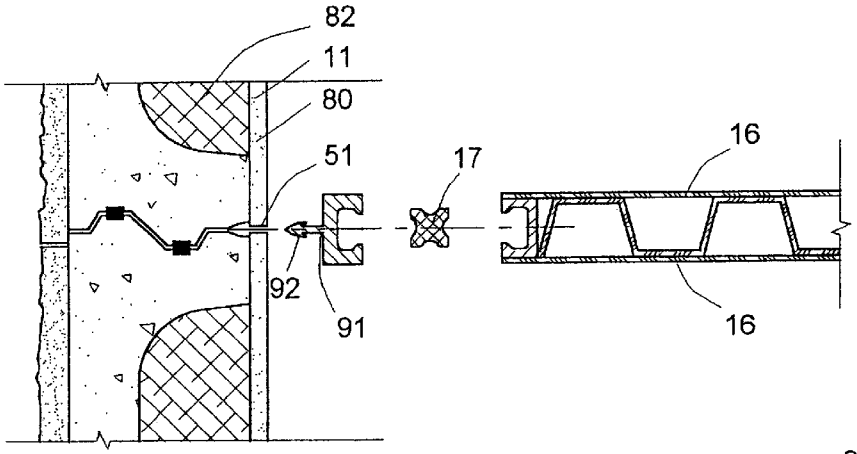
FIGS. 10*a*–10*d* illustrate the nature of the interior corrugated partitions. Specifically.
Figure 10C:
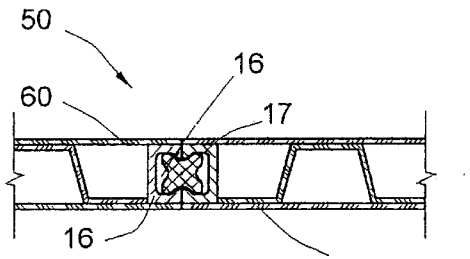

In the case of adjacent panels 60,60, when the C-shaped mortises 16 of the peripheral edges 72 of the adjacent panels are placed facing each other, the X-connector tenons 17 can be slid along the facing mortises 16 wherein two wings 19 engage one mortise 16 while the remaining two wings 19 engage the other opposing mortise 16. Thus, as shown in FIG. 10*c,* the X-connector tenon joins two panels 60,60 together.

The constricted opening of the C-shaped mortise prevents lateral release of the two engaged wings 19 and prevents separation of the panels 60. Accordingly, the only permitted displacement of the X-connector tenon 17 is linearly along the mortise 16.

Walls, Floor and Roof Panels

The second type of composite panel 61 and 62, as seen in FIGS. 1 and 9, is constructed of a HS concrete outer sheet 80 and has perpendicular stiffeners or flanges 81 for forming a channel section. An example of use of such a panel 61 is the floor panels 13. Utilities and the like can be run between the flanges 81. Mortises 16 are formed at the peripheral edges 72, both top and bottom, for connection to walls 11 and piles 20 respectively.

An insulated panel 62 is used for prefabricated and insulating exterior panels, such as wall 11 and roof panels 14. A low-density, ultra-low tensile strength, highly-aerated concrete filler 82 (hereinafter referred to as "aerated concrete") is placed in between the flanges 81 of the channel section. The filler 82 acts as an insulation which also increases the panel's diagonal rigidity. Again, mortises 16 are formed at the peripheral edges 72, on each of the two sides, top and bottom, for connection to adjacent walls 11, crown beam 40 and floor panels 13 respectively.

Suspension—Beam and spacers

Support beams for the suspension system 12, best seen in FIG. 1, can be formed using a plurality of corrugated panels 60 such as those used to form the triple-ply beam 31.

Triple-ply strong beams 31 and single ply weaker spacer beams 32, are supported at the piles 20. The beams 31,32 can be positioned using tongue 24 and groove 25 connectors for positioning on the piles 20 using a mortise 16 and tenon 17 connection.

Suspension System—Pilings

Two types of supports are provided to accommodate local conditions; particularly to facilitate construction on either a shifting or on a more consolidated base.

Referring to FIGS. 1, 1*b,* 4*a* and 4*b* a piling 20 is used construction on soft soil. The piling is an FPR pultruded rod with an auger tip 21 on the bottom for screwing into soil, and a square milled top 22. The beams 31,32 of the suspension system 12 are supported on the milled top 22 of the piles 20. In soft-soil conditions, this type of pile is easily relocatable should the ground shift.

In consolidated terrain, a mere pad 23 can be substituted for the piles.

Floors

Floor panels 13 are secured to the suspension system 12, as shown in FIGS. 1–1*c,* being anchored to the beams at the outside perimeter of the grid 30. These panels 13 are formed first with a tongue 24 or groove 25 to mesh with a groove or tongue on the pile's milled top 22 to act as a locator and secondly with a continuous dovetail mortise 16 in the floor 13 to facilitate joining to a mortise 16 in the pile using the X-connector tenons 17. The floor panels 13 are amenable to installation of heat transfer tubes and installation of other utilities between their flanges 81. The panels 13 can be profiled at their ends to match the wall profile, such as if the wall was curved.

Exterior Walls

Figure 10D:
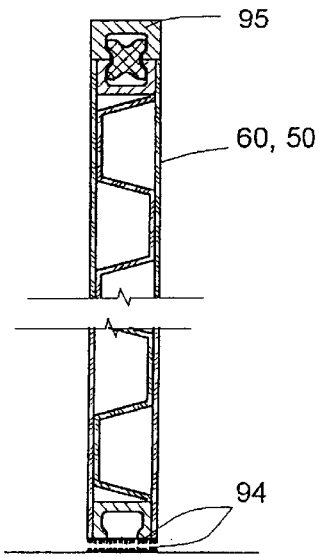
Figure 10A:
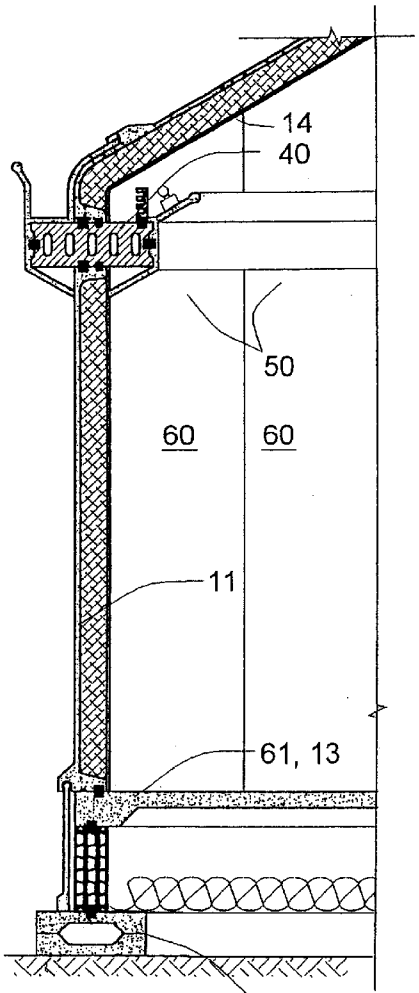
Figure 11:
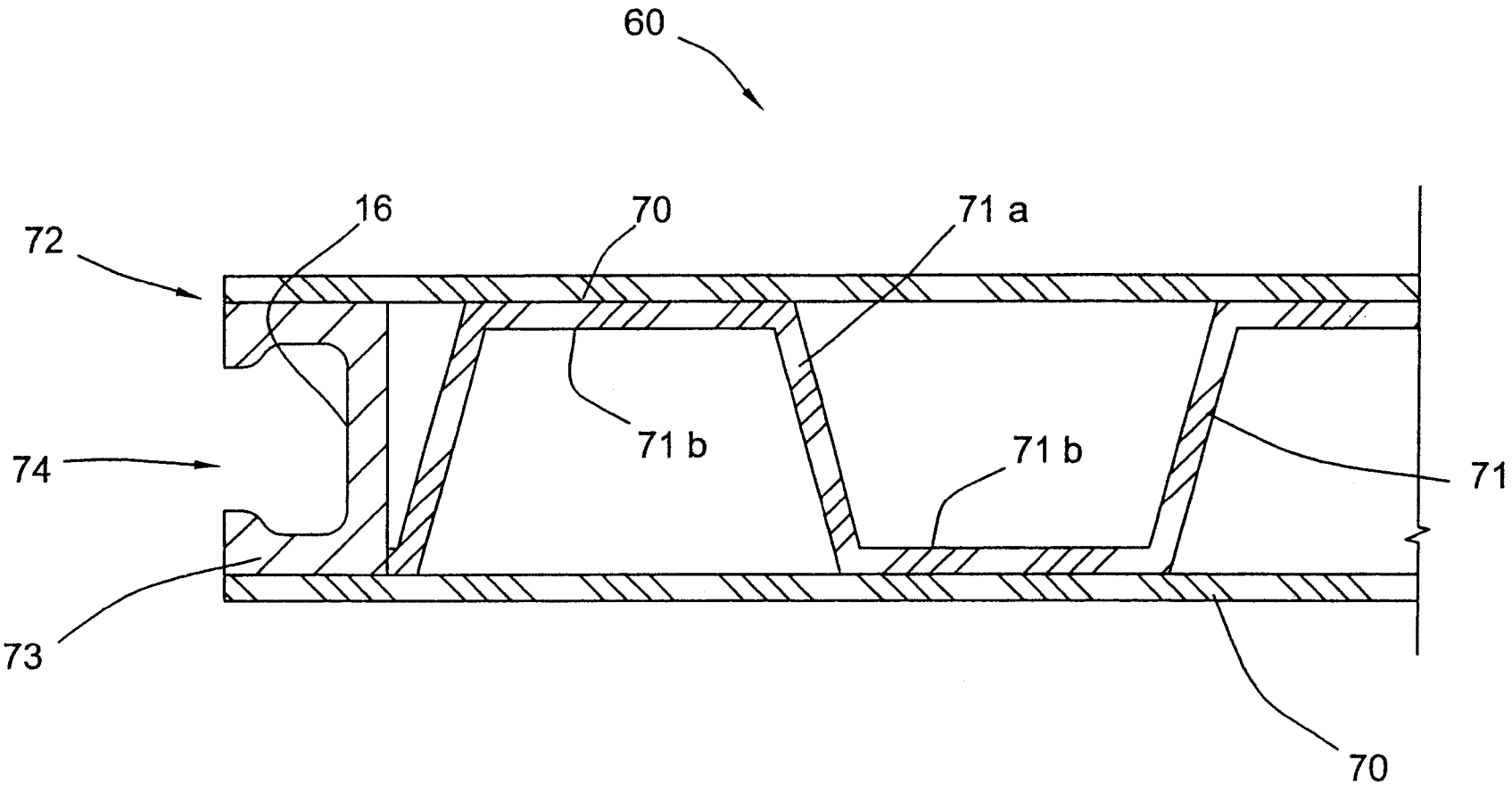
FIG. 11 is a partial cross-sectional view of a corrugated panel.

Exterior walls 11, seen in FIGS. 1, 9 and 10*a,* are formed having an exterior concrete shell 80, a foamed concrete fill 82 and a skreeded interior concrete surface (not detailed). Exterior walls 11 are joined to the floor channels by a series of continuous dovetail mortises in the top of the floor panel 13 which corresponds to dovetail mortises 16 formed on the bottom of the exterior walls 11. Connections are secured using X-connector tenons 17. Tongue or grooves on the tops and bottoms of the walls correspond to grooves or tongues respectively on the floor panels 13 and crown beam 40 to act as locators for positioning of walls 11.

Figure 13:
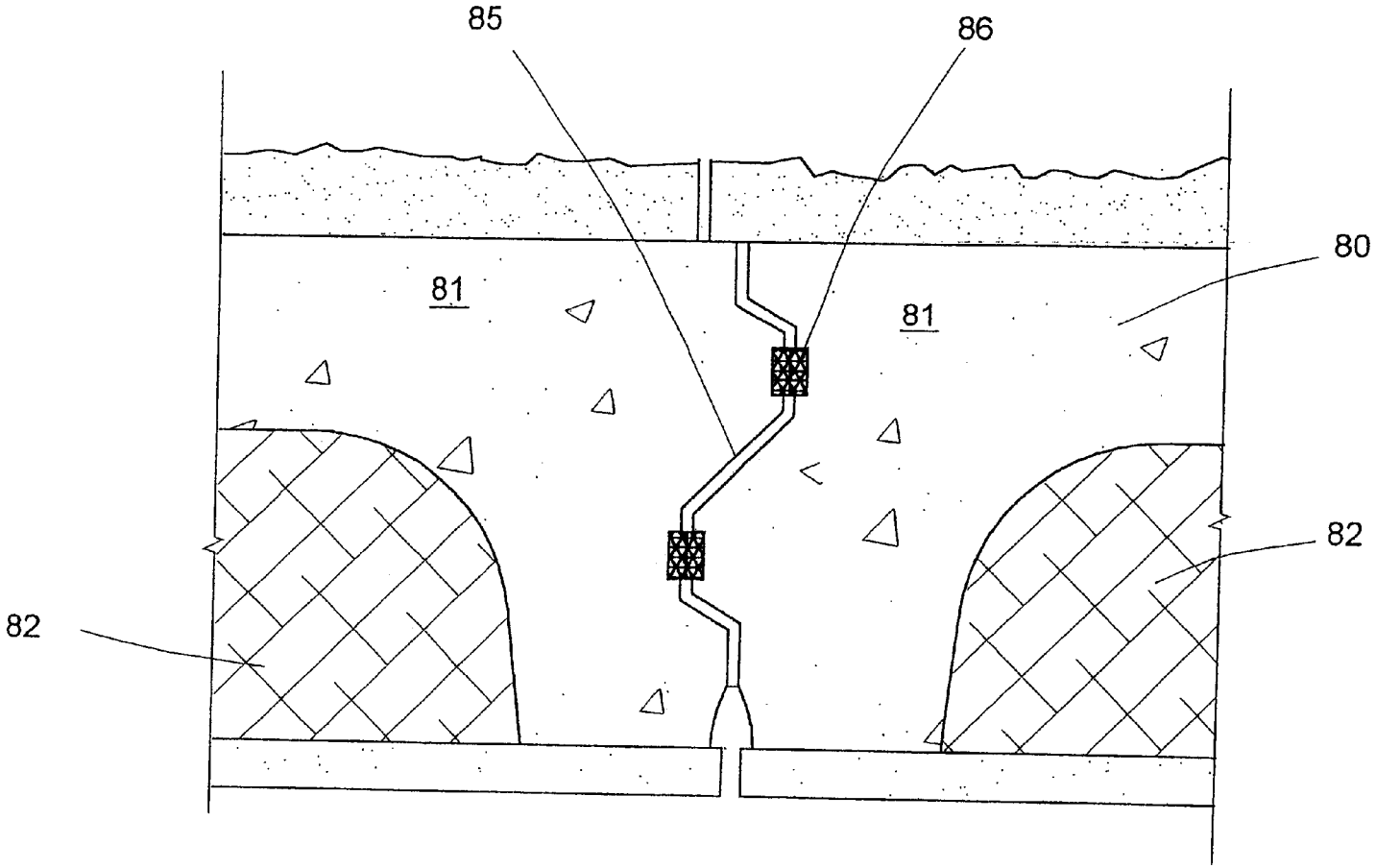
FIG. 13 is a plan cross-sectional view of a vertical tongue joint illustrating a typical serpentine external wall panel joint.

Exterior walls 11 are joined to one another side by side using a serpentine tongue joint 85, as shown in FIG. 13, sealed with a sealant adhesive 86 which prevents air, frost and contaminants from entering the building 10.

Positioning of the walls 11 typically begins at a designated wall corner and continues about the circumference of the floor panels, ending at a recessed setting point premolded into selected floor panels 13. The last wall panel 11, having a similar setting point moulded into the wall panel's sides, is levered into position to interlock with the first floor panel 13, thus providing a completely interlocked exterior finish to the building 10.

Interior Walls

Lightweight wall panels, shown in FIGS. 1 and 9, having similar corrugated construction to the panels used for the beams and spacers 31,32, only thinner, are provided for use as interior partitions 50. The panels 60 are joined together to form partitions 50 as shown in FIG. 10*a* using C-shaped extrusion mortises 16 and X-connector tenons 17, best seen in FIG. 10*c*. The partitions 50 are removeably secured to the exterior walls 11 utilizing a female socket 90 between the joints of two exterior wall panels 11, a male elongated strip connector 91 and the C-shaped mortise 16 at the panel 60. The strip connector 91 has a barb 92, which fits securely and into the complimentary socket 90, and two wings 19 of a tenon for fitting with the adjacent panel's mortise 16. The partitions 50 are readily connected to the floor panels 13 using conventional hook and loop fasteners 94 (Velcro™) as seen in FIG. 10*d*.

As shown in FIG. 10*d*, where the partitions 50 are open to the roof 14, they are capped using an extruded cap 95. The partitions 50 are also able to support the optional addition of ceilings (not shown). In cases where enhanced circulation is necessary, ceilings are omitted. In cases where ceilings are useful, the same partitions 50 can be used as ceiling material and are constructed to join to the partitions' mortises using suitable right angle connect or tenons.

Crown beam and roof construction

A crown beam 40, seen in FIGS. 6 and 7, is formed from HS concrete, having lightening holes 100 along its horizontal axis, to reduce the weight of the beam 40. It is used similarly as it would be in a conventional construction for roofs built without trussing or rafters. In such cases, it is normally placed vertically with respect to the exterior walls. The addition of a crown beam 40 provides means, at the point of juncture between the wall panels 11 and the roof 14, to accept the spreading load therefrom. This load would otherwise be dependent upon the walls 11 and could result in wall deviation.

Rather than being placed in the conventional vertical position which would result in extra wall height, the crown beam 40 is placed horizontally on top of the walls 11. Due to its width, the crown beam 40 creates a protuberance on the outside and on the inside of the walls 11, which further allows it to be used as a building component suitable for the addition of external and internal structural and architectural attachments.

As seen in FIG. 7, externally the crown beam 40 is used as an anchor for a concrete rain gutter 41 capable of controlling large volumes of water flow such as might be found in a monsoon. The exposed face of the gutter 41 provides one form of a substitute for the soft and fascia found in conventional construction and minimizes the wind loading, and associated destruction, caused by high winds.

As seen in FIG. 7, internally the crown beam 40 is used as a connection for a continuous lighting valance 42. The lighting valance 42 provides a suitable location for the installation of electrical, plumbing and communication harnesses used to provide services to the building 10.

Installation of the crown beam 40, between the wall panels 11 below and the roof panels 14 above, provides continuous horizontal strength with overall wall rigidity and relies on special joining conditions to maintain the final wall positioning. The system employs a finger joining technique, as seen in FIG. 8, designed to improve tensile strength in a lateral direction, while maintaining the required horizontal positioning or "bedding" by the casting of the finger joints 44 using a draw-casting method. This method of forming the finger joints 44 results in a downward diminishing taper for locking against movement.

The finger joints 44 are further reinforced by the insertion of epoxy fiberglass reinforcing rods 45 which extend axially into the crown beam and vertically through holes formed in the fingers of the finger joints 44.

Roof panels 14 are moulded with overlapping extensions 33 along a bottom and a first vertical side edge. Formed In this fashion, roof panels 14 can be installed by sliding the non-overlapping vertical edge of a panel under the overlapping edge of the previously installed adjacent panel, while at the same time ensuring the bottom edge overlaps panels installed below. Roof panels are connected to one another using X-connectors 17 fitted into the facing dovetail mortises 16 of the adjacent roof panels 14. The final roof panels 14 must be levered into position as they cannot be slid into position.

A peak connector 46 is installed at the apex of the roof 14 to connect the top edges of the opposing roof panels 14 where they meet. The peak connector 46, shown in FIG. 1, acts to connect and to cap the top of the roof 14.

The overlapping connection of the roof panels 14 provides a continuous, sealed structure relatively impervious to wind and rain.

Lighting Valance

The continuous lighting valance 42, as seen in FIGS. 1, 9 and 7, is connected to the interior edge of the crown beam 40 using an X-connector tenon 17 fit into dovetail mortise 16 on the crown beam 16 and the valance 42. Reflectors 96 are placed on the adjacent curved roof panel 47 to reflect light from over the valance 42 and into the spaces below.

Trays 59 are fitted into the enclosure created by the lighting valance 42 and are joined to dovetail mortise 16 in the top of the crown beam 40 using X-connector tenons as seen in FIG. 1, 9 and 7. These trays 59 are used to carry all service lines, in harness form, that can be installed or moulded into the walls 11. This includes electrical, plumbing and communication services.

Heating and Cooling System

As shown in FIG. 1, a heating and cooling system is provided having a compressed-air, constant-pressure hot air heating system and a series of floor plenums and heat transfer tubes underneath the floor panels 13.

Assembly

The panels 13,11,14 are all assembled and held rigidly together as a unit using corner wall panels 110, and hip and peak connectors 111. These connectors 110 and 111 are preferably held together using mortise and tenon connections.

The embodiment of the invention for which and exclusive property or privilege is claimed are defined as follows:

1. A system of modular concrete construction for forming a roofed and walled structure comprising:

a plurality of first lightweight composite concrete building components having at least a top linear peripheral edge formed with a linear dovetailed fitting mortise for forming wall panels;

a plurality of second lightweight composite concrete building components which have a greater lateral dimension than height, wherein at least top and bottom linear peripheral edges are formed with linear dovetailed mortises for forming crown beams;

a plurality of third lightweight composite concrete building components having at least a bottom linear peripheral edge formed with linear dovetailed fitting mortises for forming roof panels;

a plurality of flared tenons for fitting in the mortises, so that when the mortises of two or more building components are aligned, the components are joined by inserting the flared tenons along the peripheral edges and into the aligned fitting mortises; and a plurality of crown beams having top and bottom edges, joined end to end atop the wall and inserting tenons to join the bottom edges of the crown beams to the top edges of the wall panels and below the roof panels by inserting tenons to join the top edges of the crown beams to the bottom edges of the roof panels.

2. The system of claim 1 wherein the wall panels or roof panels further comprise:

a planer sheet; and flanges spaced periodically and extending perpendicularly from the sheet.

3. The system of claim 2 wherein the wall panels or roof panels further comprise aerated concrete placed between the flanges as insulation.

4. The system of claim 3 wherein the flared tenons are formed of pultruded FRP.

5. The system of claim 4 wherein the flared tenons have an "X"-shape complementary with the mortises.

6. The system of claim 1 wherein the crown beams have interlocking fingers at their ends, the fingers being vertically tapered, for joining adjacent crown beams end to end.

7. The system of claim 1 wherein the bottom ends of the roof panels further comprise extensions which overlap an aligned and joined building component.

8. The system of claim 1 further comprising:

a plurality of lightweight composite concrete purlins having at least a bottom and a top linear peripheral edges formed with linear dovetailed fitting mortises, and wherein two or more roof panels are joined to the purlins by inserting tenons to join the purlins bottom edge to a roof panels' top edge and below the roof panel by inserting tenons to join the purlins' top edge to a roof panels' bottom edge.

9. The system of claim 8 wherein the bottom ends of the purlins further comprise extensions which overlap an aligned and joined building component.

10. A method of modular concrete construction for forming a roofed and walled structure comprising the steps of:

providing a plurality of first lightweight composite concrete building components having at least a top linear peripheral edge formed with a linear dovetailed fitting mortise for forming wall panels;

providing a plurality of second lightweight composite concrete building components which have a greater lateral dimension than height, wherein at least top and bottom linear peripheral edges are formed with linear dovetailed mortises for forming crown beams;

providing a plurality of third lightweight composite concrete building components having at least a bottom linear peripheral edge formed with linear dovetailed fitting mortises for forming roof panels;

assembling the plurality of wall panels by aligning two adjacent wall panels and inserting tenons into adjacent fitting mortises to join adjacent wall panels and form a wall;

assembling the plurality of crown beams by joining them end to end atop the wall and inserting tenons to join the bottom edges of the crown beams to top edges of the wall panels; and assembling the plurality of roof panels atop the crown beam by aligning two adjacent roof panels and inserting tenons to join the bottom of the roof panels to the top edges of the crown beams.

11. A method of modular concrete construction for forming a roofed structure comprising:

providing a plurality of first lightweight composite concrete building components having at least a top linear peripheral edge formed with a linear dovetailed fitting mortise for forming wall panels;

providing a plurality of second lightweight composite concrete building components which have a greater lateral dimension than height, wherein at least top and bottom linear peripheral edges are formed with linear dovetailed mortises for forming crown beams;

providing a plurality of third lightweight composite concrete building components having at least a bottom linear peripheral edge formed with linear dovetailed fitting mortises for forming roof panels;

assembling the plurality of wall panels by aligning two adjacent wall panels and inserting tenons into adjacent fitting mortises to join adjacent wall panels and form a wall;

assembling the plurality of roof panels by aligning two adjacent roof panels and inserting tenons to join adjacent roof panels and form a roof; and installing the crown beams end to end intermediate the wall and roof for absorbing roof loading and transferring the loading vertically into the wall.

12. The method of claim 11 further comprising the step of providing lightweight concrete gutters about the roof by aligning linear mortises formed along inside edge of the gutters with linear mortises formed along outside edges of the crown beams and inserting tenons to join the gutters and crown beams.

13. The method of claim 11 further comprising the step of providing lightweight concrete valences within the roof by aligning linear mortises formed along inside edges of the valences with linear mortises formed along inside edges of the crown beams and inserting tenons to join the valences and crown beams.

14. A method of modular concrete construction comprising the steps of:

forming lightweight composite concrete building components having one or more linear peripheral edges formed with linear dovetailed fitting mortises, by forming first and second sheets of a lightweight composite concrete;

forming a third corrugated sheet of a lightweight composite concrete;

sandwiching the third sheet between the first and second sheets to form a corrugated panel having at least two opposing linear peripheral edges;

inserting an FRP extrusion into at least two linear peripheral edges for forming a mortise;

providing one or more flaring tenons;

aligning two adjacent building components with aligned fitting mortises; and joining the aligned panels by inserting one or more of the flaring tenons along the peripheral edge and into the aligned fitting mortises.

15. The method of claim 14 for forming a building which can be erected on site without skilled personnel comprising the steps of:

(a) providing a plurality of first building components having at least a top linear peripheral edge formed with linear dovetailed fitting mortises for forming wall panels;

(b) providing a plurality of second building components which having a greater lateral dimension than height, wherein at least two ends, top and bottom linear peripheral edges are formed with linear dovetailed mortises for forming crown beams;

(c) providing a plurality of third building components having at least two sides and a bottom linear peripheral edge formed with linear dovetailed fitting mortises for forming roof panels;

(d) providing a plurality of corrugated panels;

(e) placing piles at the building location in predetermined locations;

(f) erecting a suspension system of a plurality of corrugated panels acting as beams extending between piles;

(g) assembling the plurality of wall panels by inserting tenons into adjacent fitting mortises to join adjacent wall panels and form a wall supported by the suspension system;

(h) assembling the plurality of crown beam atop the wall by inserting tenons into adjacent fitting mortises to join adjacent crown beams and inserting tenons to join the crown beam's bottom edge to the wall panels' top edges; and (i) assembling the plurality of roof panels atop the crown beam by inserting tenons to join adjacent roof panels and inserting tenons to join the roof panels to the crown beams' top edges.

16. The method of claim 15 further comprising the steps of assembling a plurality of corrugated panels to form partitions within the interior of the building.

17. The method of claim 14 wherein the flaring tenons are pultruded FRP.

18. The method of claim 17 wherein the flaring tenons have an "X"-shape complementary with the mortises.

* * * * *